US012070124B2

(12) United States Patent
Whitta et al.

(10) Patent No.: US 12,070,124 B2
(45) Date of Patent: Aug. 27, 2024

(54) SHELF ASSEMBLY FOR HIGH CAPACITY STORAGE

(71) Applicant: CREATIVE PLASTIC CONCEPTS, LLC, Sycamore, OH (US)

(72) Inventors: Jacob H. Whitta, Bluffton, OH (US); Ben Sayalith, Findlay, OH (US); Eric Hummel, Findlay, OH (US); Tony Vilay, Findlay, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 0 days.

(21) Appl. No.: 17/974,090

(22) Filed: Oct. 26, 2022

(65) Prior Publication Data

US 2023/0129801 A1 Apr. 27, 2023

Related U.S. Application Data

(60) Provisional application No. 63/271,772, filed on Oct. 26, 2021.

(51) Int. Cl.
*A47B 47/00* (2006.01)

(52) U.S. Cl.
CPC ..... *A47B 47/0083* (2013.01); *A47B 47/0091* (2013.01)

(58) Field of Classification Search
CPC . A47B 47/00; A47B 47/0008; A47B 47/0016; A47B 47/0025; A47B 47/0033; A47B 47/0041; A47B 47/005; A47B 47/0083; A47B 47/0091; A47B 47/04; A47B 47/042; A47B 47/045; A47B 47/047; A47B 57/26; A47B 57/265; A47B 87/0207; A47B 87/0215; A47B 87/0223; A47B 87/0246; A47B 87/0253; A47B 96/021; A47B 2087/023; A47B 2087/0238; A47F 5/10; A47F 5/101; A47F 5/103; F16B 12/40; F16B 12/42
USPC ..... 211/134
See application file for complete search history.

(56) References Cited

U.S. PATENT DOCUMENTS 3,765,343 A * 10/1973 Ettlinger, Jr. ..... F16B 12/52 108/106
4,145,977 A * 3/1979 Yellin ..... A47B 87/0246 403/174
4,696,406 A * 9/1987 Karashima ..... A47B 96/021 403/345
4,815,394 A * 3/1989 Ettlinger ..... A47B 57/265 108/107

(Continued)

FOREIGN PATENT DOCUMENTS

CA 2268644 A1 * 11/1999 ..... A47B 87/0223
WO WO-2015106837 A1 * 7/2015 ..... A47B 47/0083

*Primary Examiner* — Joshua E Rodden
(74) *Attorney, Agent, or Firm* — Thompson Coburn LLP

(57) ABSTRACT

A shelf system includes at least one modular shelf assembly including at least one shelf unit, a plurality of support posts, an adjustable foot, covers, and anchors. The at least one shelf unit, plurality of support posts, adjustable foot, covers, and anchors are, in combination, adapted to create the modular shelf assembly. Each shelf unit is adapted to receive the plurality of support posts, including one support post generally located adjacent a rear side of the shelf unit about half-way between a first and a second end of the shelf unit.

18 Claims, 6 Drawing Sheets

(56) References Cited

U.S. PATENT DOCUMENTS 5,579,702 A * 12/1996 Aho ..... A47F 5/10 108/92
5,695,081 A * 12/1997 Alkalay ..... F16B 12/40 211/186
5,947,036 A * 9/1999 Cohen ..... A47B 57/265 108/14
D429,582 S * 8/2000 Grosfillex ..... D6/675.1
6,460,710 B1 * 10/2002 Dardashti ..... A47B 57/26 211/187
6,520,356 B2 * 2/2003 Miller, Jr. ..... A47F 5/10 211/186
6,820,757 B2 * 11/2004 Craft ..... A47B 96/021 211/188
6,908,000 B2 * 6/2005 Craft ..... A47B 81/002 211/144
7,658,154 B2 * 2/2010 Yankello ..... A47B 87/0246 108/190
9,538,846 B2 * 1/2017 Reinhart ..... A47B 96/02
10,124,479 B2 11/2018 Reinhart
10,231,544 B2 3/2019 Reinhart
10,299,590 B2 * 5/2019 Olson ..... A47B 96/021
D875,448 S 2/2020 Reinhart et al.
10,709,238 B1 * 7/2020 Thompson ..... A47B 96/066
11,350,743 B2 6/2022 Reinhart et al.
2002/0046982 A1 * 4/2002 Guizzardi ..... A47B 57/545 211/187
2004/0159622 A1 * 8/2004 Craft ..... A47B 87/0246 108/106
2008/0053940 A1 * 3/2008 Whalen ..... A47F 5/0043 211/134
2009/0242501 A1 * 10/2009 Yankello ..... A47B 87/0246 211/153
2016/0015174 A1 * 1/2016 Guizzardi ..... A47B 96/024 211/186
2020/0100588 A1 * 4/2020 Reinhart ..... A47B 87/0223

* cited by examiner

SHELF ASSEMBLY FOR HIGH CAPACITY STORAGE

CROSS REFERENCE TO RELATED APPLICATIONS

This application claims the benefit of U.S. Provisional Application Ser. No. 63/271,772, filed on Oct. 26, 2021. The disclosure of the above application is incorporated herein by reference.

FIELD

The present disclosure relates to shelf assemblies, and more particularly, to shelves and support posts for shelf assemblies.

INTRODUCTION

The statements in this section merely provide background information related to the present disclosure and may not constitute prior art.

Modular shelving systems include a plurality of shelves vertically stacked and interconnected via vertical support posts. Typically, each shelf includes an opening at each corner configured to receive an end of a support post thereby allowing successive shelves to be stacked by inserting support posts in the openings of adjacent shelves. The number of shelves and height may be influenced by what the shelves are being used for and the amount of space available where the shelf system is placed.

Undesirably, when a shelf is heavily loaded, the shelf may deflect or sag wherein the shelf is no longer a substantially flat surface and thereby reducing the structural integrity of not only the shelf, but the entire shelving system. This can lead to the items placed on the shelf system to shift, tip over, and/or fall causing damage to the items and anything else surrounding the shelving system. Heavy loads can also cause the support posts to bow in such a way that further reduces the structural integrity resulting in the shelving system itself tipping over and possibly causing damage to the items on the shelf, the shelfing system and anything else in the vicinity of the shelving system.

There is a continuing need for a shelving system with increased structural integrity that can properly support various loads.

SUMMARY

In concordance with the instant disclosure, a shelving system with increased structural integrity that can properly support various loads, is surprisingly discovered.

In an exemplary embodiment, a shelf system including five support posts, which provides greater structural integrity for properly supporting various loads, and which reduces deflection and/or sag at the center of a shelf.

In one embodiment, a shelf unit for a shelf assembly, comprises a shelf body and a plurality of support posts. The shelf body has a first end, a second end, a front side, a rear side, and an integral receiver. The integral receiver of the shelf body is disposed adjacent the rear side of the shelf body between the first end and the second end of the shelf body. One of the plurality of support posts is an integral receiver post received by the integral receiver of the shelf body.

In another embodiment, a modular shelf assembly comprises a shelf unit, a plurality of support posts and at least one anchor. The shelf unit includes a shelf body and at least one shelf end cap. The shelf body has a first end, a second end, a front side, a rear side, at least one connecting arm opening, at least one upper support opening and at least one lower support opening, and an integral receiver. The integral receiver of the shelf body is disposed adjacent the rear side of the shelf body between the first end and second end of the shelf body. The integral receiver is reinforced by at least one reinforcing member integrally connected to the integral receiver and an adjacent wall. The at least one shelf end cap has at least one connecting arm with at least one end cap receiver formed in the at least one connecting arm. The at least one connecting arm is received in the at least one connecting arm opening in the shelf body. The at least one end cap receiver is in substantial axial alignment with the at least one upper support opening and the at least one lower support opening of the shelf body. One of the plurality of support posts is an integral receiver post received by the integral receiver of the shelf body. At least one of the plurality of support posts is a corner post received by the at least one end cap receiver. The at least one anchor cooperates with at least one of the plurality of support posts to facilitate securing the shelf unit to an adjacent structure.

In yet another embodiment, a kit for a shelf assembly, comprises a shelf unit, a plurality of support posts, at least one anchor, a plurality of covers and a plurality of feet. The shelf unit including a shelf body and at least one shelf end cap. The shelf body has a first end, a second end, a front side, a rear side, at least one connecting arm opening, at least one upper support opening and at least one lower support opening, and an integral receiver. The the integral receiver is disposed adjacent the rear side of the shelf body between the first end and second end of the shelf body and the integral receiver is reinforced by at least one reinforcing member integrally connected to the integral receiver and an adjacent wall. The at least one shelf end cap has at least one connecting arm with at least one end cap receiver formed in the at least one connecting arm. The at least one connecting arm is configured to be received in the at least one connecting arm opening in the shelf body and position the at least one end cap receiver in substantial axial alignment with the at least one upper support opening and the at least one lower support opening of the shelf body. One of the plurality of support posts is an integral receiver post configured to be received by the integral receiver of the shelf body. At least one of the plurality of support posts is a corner post configured to be received by the at least one end cap receiver. The at least one anchor is configured to cooperate with at least one of the plurality of support posts to facilitate securing the shelf unit to an adjacent structure. Each of the plurality of covers is configured to be received by one of the integral receiver of the shelf body and the at least one end cap receiver of the at least one shelf end cap. Each of the plurality of feet is configured to be received by one of the integral receiver of the shelf body and the at least one end cap receiver of the at least one shelf end cap.

a modular shelf assembly, comprises a shelf unit including a shelf body and at least one shelf end cap, the shelf body having a first end, a second end, a front side, a rear side, at least one connecting arm opening, at least one upper support opening and at least one lower support opening, and an integral receiver, wherein the integral receiver is adjacent the rear side of the shelf body between the first end and second end of the shelf body and the integral receiver is reinforced by at least one reinforcing member integrally connected to the integral receiver and an adjacent wall, the at least one shelf end cap having at least one connecting arm with at least one end cap receiver formed in the at least one connecting arm, the at least one connecting arm configured to be received in the at least one connecting arm opening in the shelf body and position the at least one end cap receiver in substantial axial alignment with the at least one upper support opening and the at least one lower support opening of the shelf body; a plurality of support posts wherein one of the plurality of support posts is an integral receiver post configured to be received by the integral receiver of the shelf body and at least one of the plurality of support posts is a corner post configured to be received by the at least one end cap receiver; and at least one anchor, wherein the at least one anchor is configured to cooperate with at least one of the plurality of support posts to facilitate securing the shelf unit to an adjacent structure.

In a further embodiment, a kit for a shelf assembly, comprises a shelf unit including a shelf body and at least one shelf end cap, the shelf body having a first end, a second end, a front side, a rear side, at least one connecting arm opening, at least one upper support opening and at least one lower support opening, and an integral receiver, wherein the integral receiver is adjacent the rear side of the shelf body between the first end and second end of the shelf body and the integral receiver is reinforced by at least one reinforcing member integrally connected to the integral receiver and an adjacent wall, the at least one shelf end cap having at least one connecting arm with at least one end cap receiver formed in the at least one connecting arm, the at least one connecting arm configured to be received in the at least one connecting arm opening in the shelf body and position the at least one end cap receiver in substantial axial alignment with the at least one upper support opening and the at least one lower support opening of the shelf body; a plurality of support posts wherein one of the plurality of support posts is an integral receiver post configured to be received by the integral receiver of the shelf body and at least one of the plurality of support posts is a corner post configured to be received by the at least one end cap receiver; at least one anchor, wherein the at least one anchor is configured to cooperate with at least one of the plurality of support posts to facilitate securing the shelf unit to an adjacent structure; a plurality of covers, wherein each of the plurality of covers is configured to be received by one of the integral receiver of the shelf body and the at least one end cap receiver of the at least one shelf end cap; and a plurality of feet, wherein each of the plurality of feet is configured to be received by one of the integral receiver of the shelf body and the at least one end cap receiver of the at least one shelf end cap.

In a particular embodiment, a modular shelf system having a plurality of shelf assemblies vertically stacked in alignment with one another is shown. The shelf assemblies are stacked one over the other. A plurality of support posts extend between each shelf assembly. In one example, the shelf system includes five shelf assemblies and five support post extending between each shelf assembly configured to interconnect and stabilize the shelf assemblies.

In a non-limiting example, the shelf system may be formed from a lightweight plastic material such as a polypropylene plastic material, by a molding process such as injection molding. However, it should be understood that the shelf system may be formed from any suitable material, including other thermoplastic materials such as polyethylene, and non-thermoplastic materials such as foam or metal. Nonetheless, one skilled in the art may employ any suitable process for forming the shelf system, as desired.

Each shelf assembly includes a shelf body having a first end and a second end, and a shelf end cap connected to each one of the first end and the second end. The shelf end cap is configured to provide additional stability to the shelf system. In a non-limiting example, the shelf assemblies may be substantially rectangular, however, it should be understood that one skilled in the art may employ other shapes, as desired.

Each shelf body further includes a top side, a bottom side, and a plurality of receiving holes extending between the top side and bottom side of the shelf body. Each shelf body includes five receiving holes, wherein four of the five receiving holes are located at corresponding corners of the shelf body and the fifth receiving hole is centrally located at a rear portion of the shelf body. More specifically, the shelf body includes a first receiving hole at a front right corner, a second receiving hole at a front left corner, a third receiving hole at a rear right corner, a fourth receiving hole at a rear left corner, and a fifth receiving hole between the third and fourth receiving holes. The third receiving hole, fourth receiving hole, and fifth receiving hole may be equally spaced along the rear portion of the shelf body.

Each receiving hole includes an upper opening on the top side of the shelf body and a lower opening on the bottom side of the shelf body. The upper and lower openings are configured to facilitate stacking of the shelf assemblies. It should be appreciated that one skilled in the art may employ any number the receiving holes or the location of the receiving holes depending on the overall shape of the shelf body.

Each support post includes a top portion and a bottom portion. The top portion of the support post is configured for sliding engagement with the lower opening of the receiving hole. The bottom portion of the support post is configured for sliding engagement with the upper opening of the receiving hole. As such, the upper opening and lower opening of each receiving hole is geometrically shaped to correspond with a shape of the top portion and bottom portion of the support posts, respectively. For example, the lower opening of the receiving hole is square shaped to correspond with a support post defining a square shape.

The top portion of the support post may define a width less than a width of the lower opening of the shelf body to facilitate fitting of the top portion into the lower opening. The bottom portion of the support post may define a width less than a width of the upper opening of the shelf body to facilitate fitting of the bottom portion into the upper opening.

The shelf system may further include a top cap configured to be disposed through the upper opening of each receiving hole on the upper most shelf assembly. The top cap includes a cap body defining a width that is smaller than a width of the upper opening of the shelf body to facilitate fitting of the cap body into the upper opening.

The shelf end cap includes at least two arms configured to be inserted into arm openings on the first and second ends of each shelf body. Each arm is shaped such that an interference fit is established between each arm and the corresponding arm opening. Each arm of the shelf end cap further defines an aperture having a geographic shape corresponding to the shape of the support post and receiving holes. Each aperture is square shaped to correspond to the square shaped support posts and receiving holes.

In operation, the two arms of the shelf end cap are inserted into arm openings in the ends of the shelf body. Once the shelf end cap is installed, the aperture of the shelf end cap is aligned with the receiving hole of the shelf body. Next, the top cap is inserted into the upper opening on the top side of the shelf body. When the top cap is pushed into place, the cap body is in mating contact with inner walls of the aperture of the shelf end cap and an inner wall of the receiving hole establishing an interference fit.

In certain embodiments, each shelf end cap may have a plurality of interlocking apertures formed on an outer wall, a first side wall, and a second side wall of each shelf end cap. In a non-limiting example, there may be two interlocking apertures formed in the outer wall, and a single interlocking aperture formed in each side wall. The interlocking apertures may be configured to receive an interlocking component. The interlocking component may have a symmetrical shape, which permits the interlocking component to be received by different interlocking apertures of the same shape.

In one embodiment, the interlocking component is generally H-shaped. In this embodiment, for example, the interlocking apertures are generally T-shaped to receive a portion of the H-shaped interlocking component. In particular, a T-shaped portion of the at least one interlocking component is configured to be received by the T-shaped interlocking aperture. However, one of ordinary skill in the art may select other suitable shapes for the interlocking aperture and the interlocking component, as desired. Advantageously, the interlocking apertures and the interlocking component are used to connect multiple shelf assemblies. For example, a first connecting portion of the interlocking component is disposed in each shelf end cap of a first shelf assembly, and a second connecting portion of the interlocking component is disposed on the shelf end cap of a second shelf assembly.

The upper most (top) shelf assembly has a top cap installed in the upper opening of each one of the five receiving holes.

The shelf system may include an adjustable foot and an adjustor adapted to reinforce the shelf system. The adjustable foot may be disposed within the lower opening of the receiving holes of the bottom most shelf assembly of the shelf system. The adjustable foot is configured to alter the height of the shelf system. The adjustable foot may have an externally threaded portion and the adjustor may have an internally threaded portion, whereby the height of the adjustable foot is adjusted by rotating the adjustable foot clockwise or counterclockwise. For example, the adjustor may lower the height of the adjustable foot by rotating clockwise and raise the height of the adjustable foot by rotating counterclockwise.

The shelf system may include a wall anchor configured to secure the shelf system to an adjacent wall thereby inhibiting the shelf system from tipping over. The wall anchor includes a front wall and opposing side walls configured to engage a support post adjacent the wall. Each opposing side wall includes an outwardly extending protrusion defining a through hole for receiving an attachment feature, such as a nail or screw, for attaching the wall anchor to the wall. When the wall anchor is installed, the front wall, opposing side walls, and the wall enclose the support post thereby securing the shelf system to the wall. One skilled in the art may employ two or any number of wall anchors, as desired.

The shelf system may include a plurality of shelf assemblies, where the shelf assemblies are vertically stacked one over the other in alignment with one another. A plurality of support posts extend between each shelf assembly and are configured to interconnect and stabilize the shelf assemblies. Each shelf assembly includes a shelf body, a shelf end cap attached to ends of the shelf body, a plurality of receiving holes, and a plurality of top caps disposed in a corresponding receiving hole. The plurality of receiving holes are disposed at each corner of the shelf body. In a non-limiting example, a fifth receiving hole is centrally located at the rear portion of the shelf body. The difference between this shelf system and other embodiments is that each receiving hole defines an octagonal shape, as opposed to a square shape.

The octagonal receiving holes are configured to receive an octagonal support post to facilitate stacking of the shelf assemblies. The support post and receiving hole connection further provides stability and support to the shelf system. It has been advantageously found that providing a fifth support post, centrally located between opposing corners, inhibits the center of the shelf body from sinking when the shelf is heavily loaded thereby increasing the structural integrity of the shelf system.

It should be understood that the plurality of top caps define a shape that corresponds to the shape of the receiving hole.

A modular shelf system according to another embodiment of the present disclosure includes that each receiving hole of this shelf system defines a circular shape instead of square or octagon shapes. Each circular receiving hole is configured to receive a circular support post. Furthermore, the shelf system may include a plurality of top caps defining a shape corresponding to the shape of the receiving hole.

It has been advantageously found that providing a fifth support post, centrally located between opposing corners, inhibits the center of the shelf body from sinking when the shelf is heavily loaded thereby increasing the structural integrity of the shelf system.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 4:
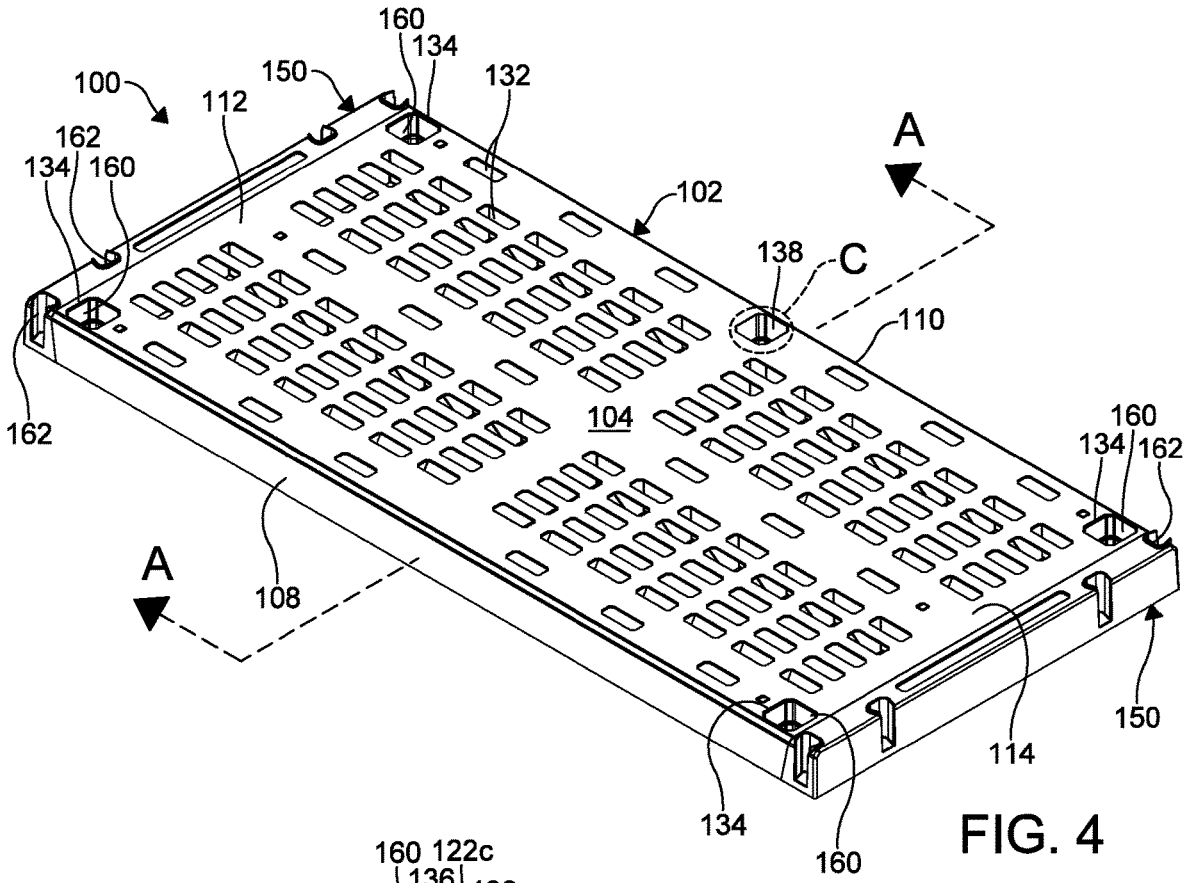
FIG. 4 is a top perspective view of a shelf unit of the modular shelf assembly shown in FIG. 1 according to another embodiment of the present disclosure.
Figure 9:
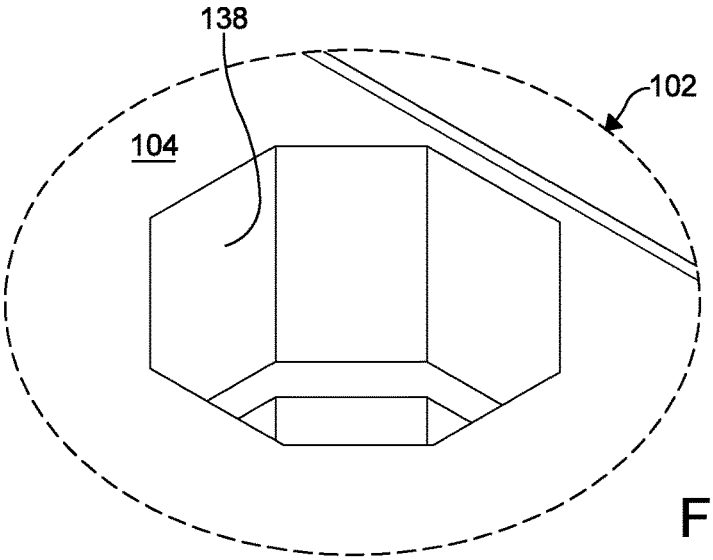
Figure 10:
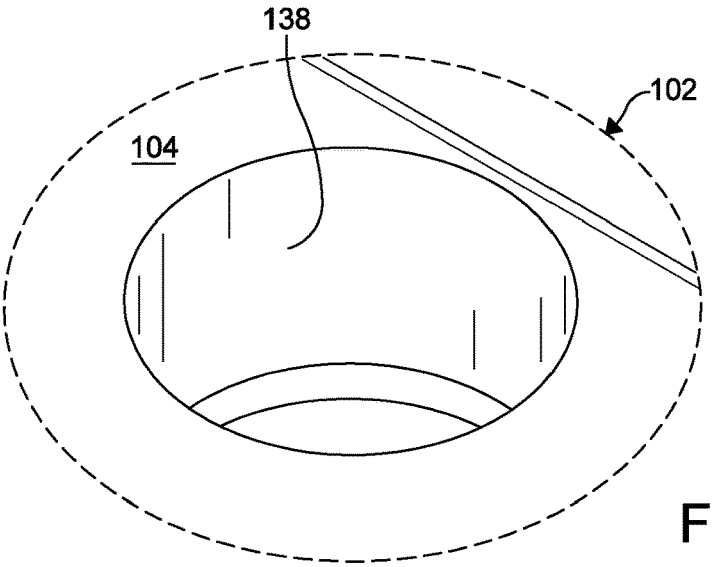

FIG. 9 is an enlarged, fragmentary top perspective view of a shelf unit taken at call-out C in FIG. 4 according to another embodiment of the present disclosure, illustrating a shelf unit having an octagonal shaped integral receiver; and FIG. 10 is an enlarged, fragmentary top perspective view of a shelf unit taken at call-out C in FIG. 4 according to another embodiment of the present disclosure, illustrating a shelf unit having a round shaped integral receiver.

DETAILED DESCRIPTION

The following description of technology is merely exemplary in nature of the subject matter, and is not intended to limit the present disclosure, application or uses. It should be understood that throughout the drawings, corresponding reference numerals indicate like or corresponding parts and features.

Modular shelf assemblies are disclosed in applicant's co-owned U.S. Pat. No. 11,350,743, the entire disclosure of which, is incorporated herein by reference. Where any conflict or ambiguity can exist between U.S. Pat. No. 11,350,743 and this detailed description, the present detailed description controls.

Referring to FIGS. 1-10, a modular shelf assembly 1 is shown that is adapted to interlock with adjacent modular shelf assemblies 1. In certain embodiments, the modular shelf assembly 1 may include at least one shelf unit 100, a plurality of support posts 200, an adjustable foot 300, and an anchor 400. The at least one shelf unit 100, the plurality of support posts 200, the adjustable foot 300, and the anchor 400, in combination, are adapted to create the modular shelf assembly 1.

In a non-limiting example, the shelf assembly 1 may be formed from a lightweight plastic material such as a polypropylene plastic material, by a molding process such as injection molding. However, it should be understood that the shelf assembly 1 may be formed from any suitable material or a plurality of suitable materials, including other thermoplastic materials such as polyethylene, and non-thermoplastic materials such as foam or metal. Nonetheless, one skilled in the art may employ any suitable process for forming the shelf system 2, as desired.

With further reference to FIGS. 1-7, and in particular embodiments, each shelf unit 100 may include a shelf body 102 having a top side 104, a bottom side 106, a front side 108, a rear side 110, a first end 112, a second end 114, and at least one shelf end cap 150. The at least one shelf end cap 150 may include a first shelf end cap 150 and a second shelf end cap 150. The first shelf end cap 150 may be adapted to connect with the first end 112 of the shelf body 102, and the second shelf end cap 150 may be adapted to connect with the second end 114 of the shelf body 102, thereby creating the shelf unit 100.

In a non-limiting example, the shelf unit 100 may be substantially rectangular and have four corners. However, other shapes for the shelf unit 100 may also be selected by a skilled artisan, within the scope of the present disclosure.

Figure 3:
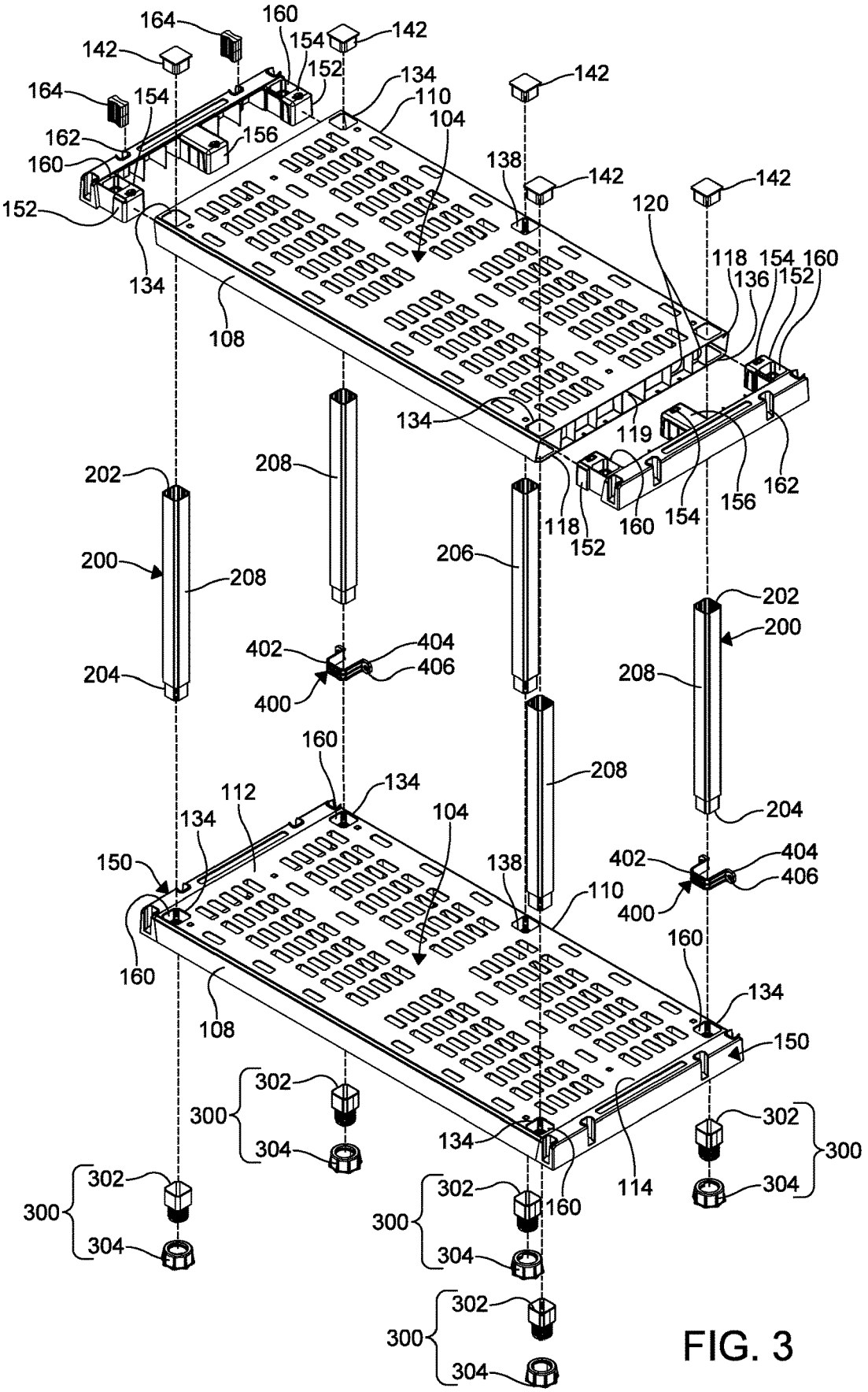
FIG. 3 is an exploded top perspective view of the shelf assembly according to another embodiment of the present disclosure.

With further reference to FIGS. 3, in certain embodiments, the shelf body 102 may have a mostly hollow interior that includes connecting arm openings 118 formed in the first end 112 and the second end 114 of the shelf body 102. The connecting arm openings 118 may be adapted to receive a connecting arm 152 disposed on the at least one shelf end cap 150. Support members 120 are provided adjacent the first end 112 and the second end 114 of the shelf body 102. In the illustrated embodiment, the support members 120 extend between and are integrally formed with the top side 104 and the bottom side 106 of the shelf body 102.

Figure 5:
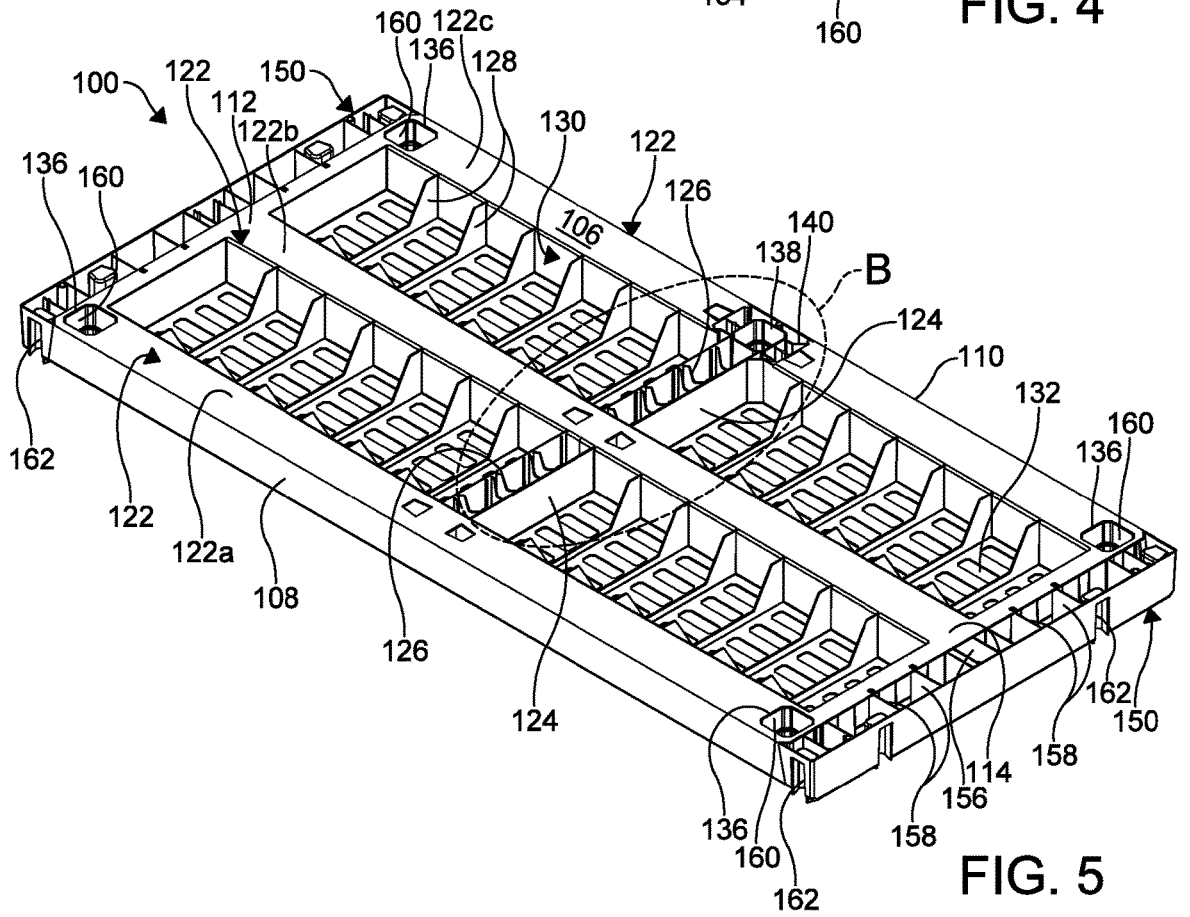
FIG. 5 is a bottom perspective view of the shelf unit shown in FIG. 4.
Figure 6:
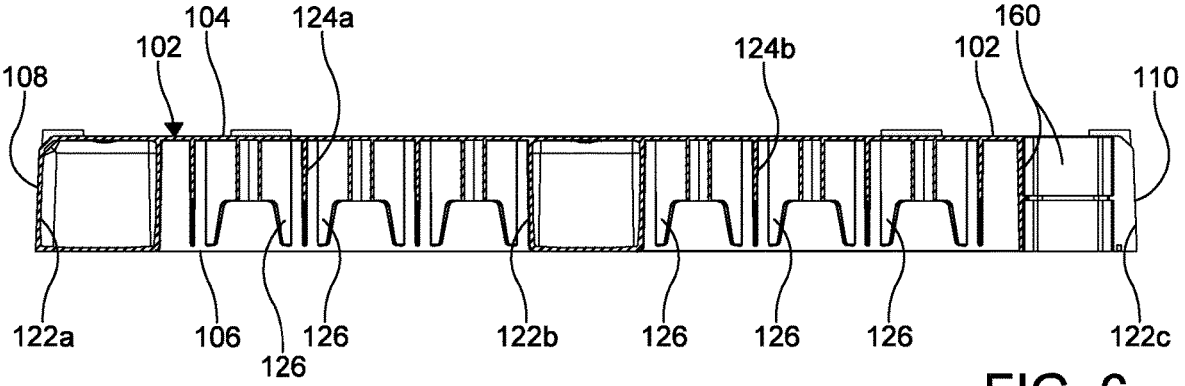
FIG. 6 is a cross-sectional side elevational view of the shelf unit taken at section line A-A in FIG. 4.
Figure 7:
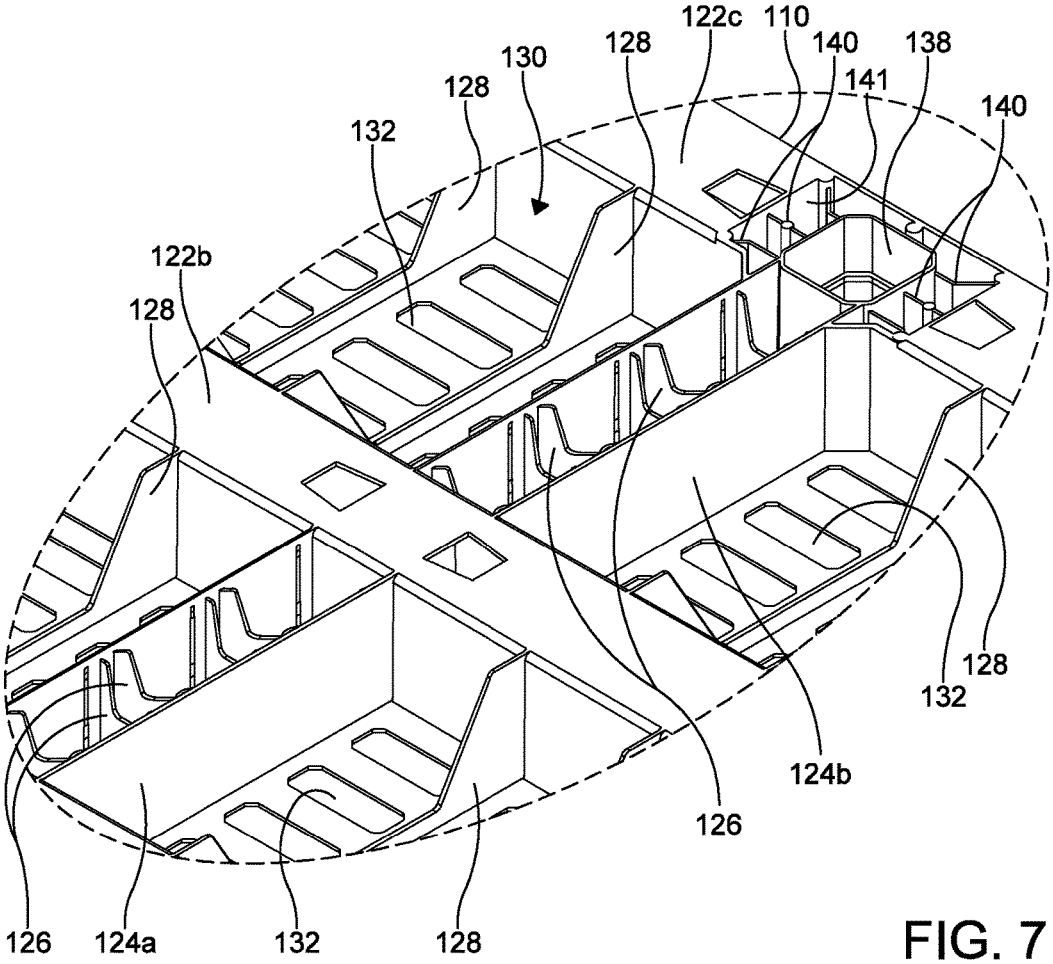
FIG. 7 is an enlarged, fragmentary bottom perspective view of the shelf unit taken at call-out B in FIG. 5, showing an integral receiver and integral receiver support, a plurality of crossbars and reinforcing bars, and reinforcing strips of the shelf unit.

As shown in FIGS. 5-7, the shelf body 102 may include at least one crossbar 122 that extends from the first end 112 to the second end 114 of the shelf body 102. The at least one crossbar 122 may be hollow and integrally molded in the shelf body 102 and adapted to support and minimize a deflection of the top side 104 of the shelf body 102. In the illustrated embodiment, three of the at least one crossbars 122 are provided, a front crossbar 122*a* adjacent the front side 108 of the shelf body 102, a rear crossbar 122*c* adjacent the rear side 110 of the shelf body 102, and a middle crossbar 122*b* substantially centered between and parallel to the front side 108 the rear side 110 of the shelf body 102. The shelf body 102 may also include at least one reinforcing bar 124 that is integrally connected to at least one of the at least one crossbars 122. In the illustrated embodiment, two of the at least one reinforcing bars 124 are provided, a front reinforcing bar 124*a* and a rear reinforcing bar 124*b*. The front reinforcing bar 124*a* is disposed between and connected to the front crossbar 122*a* and the middle crossbar 122*b*. The rear reinforcing bar 124*b* is disposed between and is connected to the middle crossbar 122*b* and the rear crossbar 122*c*. The at least one reinforcing bar 124 may include a plurality of reinforcing members 126 integrally formed therewith, wherein the at least one reinforcing bar 124 and reinforcing members 126 are configured to cooperate with the at least one crossbar 122 to support and minimize a deflection of the top side 104 of the shelf body 102. Furthermore, one skilled in the art may select, as desired, other shapes, locations and number of the at least one crossbar 122 and the at least one reinforcing bar 124 as well as other shapes and locations of the reinforcing members 126 of the at least one reinforcing bar 124.

With continuing reference to FIGS. 5-7, in particular embodiments, the shelf body 102 may have a plurality of reinforcing strips 128, where the reinforcing strips 128 are spaced apart from other of the reinforcing strips 128, forming a gap 130 therebetween. The reinforcing strips 128 are connected to adjacent at least one crossbars 122 to cooperate therewith to support and minimize a deflection of the top side 104 of the shelf body 102. As shown, through holes 132 may be formed in the top side 104 of the of the shelf body 102 in the area of the gap 130 between adjacent reinforcing strips 128. It should be understood that the at least one crossbar 122, the at least one reinforcing bar 124, the reinforcing strips 128 and the through holes 132 cooperate to minimize a weigh of the shelf body 102 while maintain a desired strength and maximizing the weigh carry capacity of the modular shelf assembly 1.

With reference to FIGS. 3-7, each shelf body 102 may include a plurality of upper support openings 134 formed therein. Each of the upper support openings 134 is adapted to receive the support posts 200. In the example shown, one of the upper support openings 134 is provided adjacent each corner of the shelf body 102 and is adapted to receive a corner post 208.

With reference to FIGS. 5, each shelf body 102 may have a plurality of lower support openings 136 formed therein. Each of the lower support openings 136 is adapted to receive the support posts 200. Furthermore, each lower support opening 136 is aligned with one of the plurality of the upper support openings 134 to facilitate a stacking of support posts 200. Accordingly, the lower support openings 136 may be disposed adjacent the corners of the shelf body 102 and adapted to receive the corner post 208.

Referring now to FIGS. 3-8, an integral receiver 138 is provided adjacent the rear side 110 of the shelf body 102 in the rear crossbar 122*c*. The integral receiver 138 is adjacent and connected to an end of the rear reinforcing bar 124*b* and configured to receive an integral receiver post 206. In certain embodiments, the integral receiver 138 has dimensions that enable the integral receiver post 206 to be received in and secured by the integral receiver 138. The integral receiver 138 is at least partially surrounded by a reinforcing wall 141 that is spaced apart from the integral receiver 138. A plurality of reinforcing ribs 140 are provide that extend from the integral receiver 138 to the reinforcing wall 141, wherein the reinforcing ribs 140 and the reinforcing wall 141 cooperate to strengthen the integral receiver 138 and facilitate securely maintaining the integral receiver post 206 in the integral receiver 138.

With reference to FIGS. 3-5, the at least one shelf end cap 150 includes at least one of the connecting arms 152. In the illustrated embodiment, one of the connecting arms 152 is provided adjacent each end of the at least one shelf end cap 150. The connecting arm 152 is configured to be inserted into the connecting arm opening 118 of the shelf body 102. The connecting arm 152 may shaped such that an interference fit is established between the connecting arm 152 and the corresponding connecting arm opening 118. The connecting arm 152 may include a locking member 154 adapted to cooperate with the shelf body 102 to facilitate the retention of the connecting arm 152 in the connecting arm opening 118. The at least one shelf end cap 150 may also include one or more additional connecting members formed at selected locations along the length of the at least one shelf end cap 150. In the illustrated embodiment, one such additional connecting member is a center connecting member 156 that is provided along with a center connecting member opening 119 in the shelf body 102, wherein the center connecting member 156 is configured to be received by the center connecting member opening 119. In the illustrated embodiment, the center connecting member 156 and the center connecting member opening 119 are configured in a similar shape and size as the connecting arm 152 and connecting arm opening 118 of the shelf body 102, respectively. It should be understood that the center connecting member 156 and the center connecting member opening 119 may be configured to have a shape and size, such as a tab, for example, that is different from the connecting arm 152 and the connecting arm opening 118, respectively.

A plurality of tabs 158 are formed in the at least one shelf end cap 150 to facilitate the aligning of the at least one shelf end cap 150 with the shelf body 102 and to maximize a strength of the at least one shelf end cap 150, wherein the tabs 158 may cooperate with the support members 120 of the shelf body 102 to further facilitate the aligning of the at least one shelf end cap 150 with the shelf body 102.

Each of the connecting arms 152 provided adjacent to the ends of the at least one shelf end cap 150, include an end cap receiver 160 formed therein. When the connecting arms 152 are inserted into the connecting arm openings 118 of the shelf body 102, the end cap receiver 160 is in substantial axial alignment with the upper support openings 134 and the lower support openings 136 to enable the support post 200 to pass through one of the upper support openings 134 or one of the lower support openings 136 and into the end cap receiver 160. In the illustrated embodiment, the end cap receivers 160 are adapted to receive the corner post 208. The end cap receiver 160 has dimensions that enable the corner post 208 to be received in and secured by the end cap receiver 160. The at least one shelf end cap 150 is configured to provide additional stability to the shelf body 102, the corner post 208, and the entirety of the modular shelf assembly 1.

Figure 1:
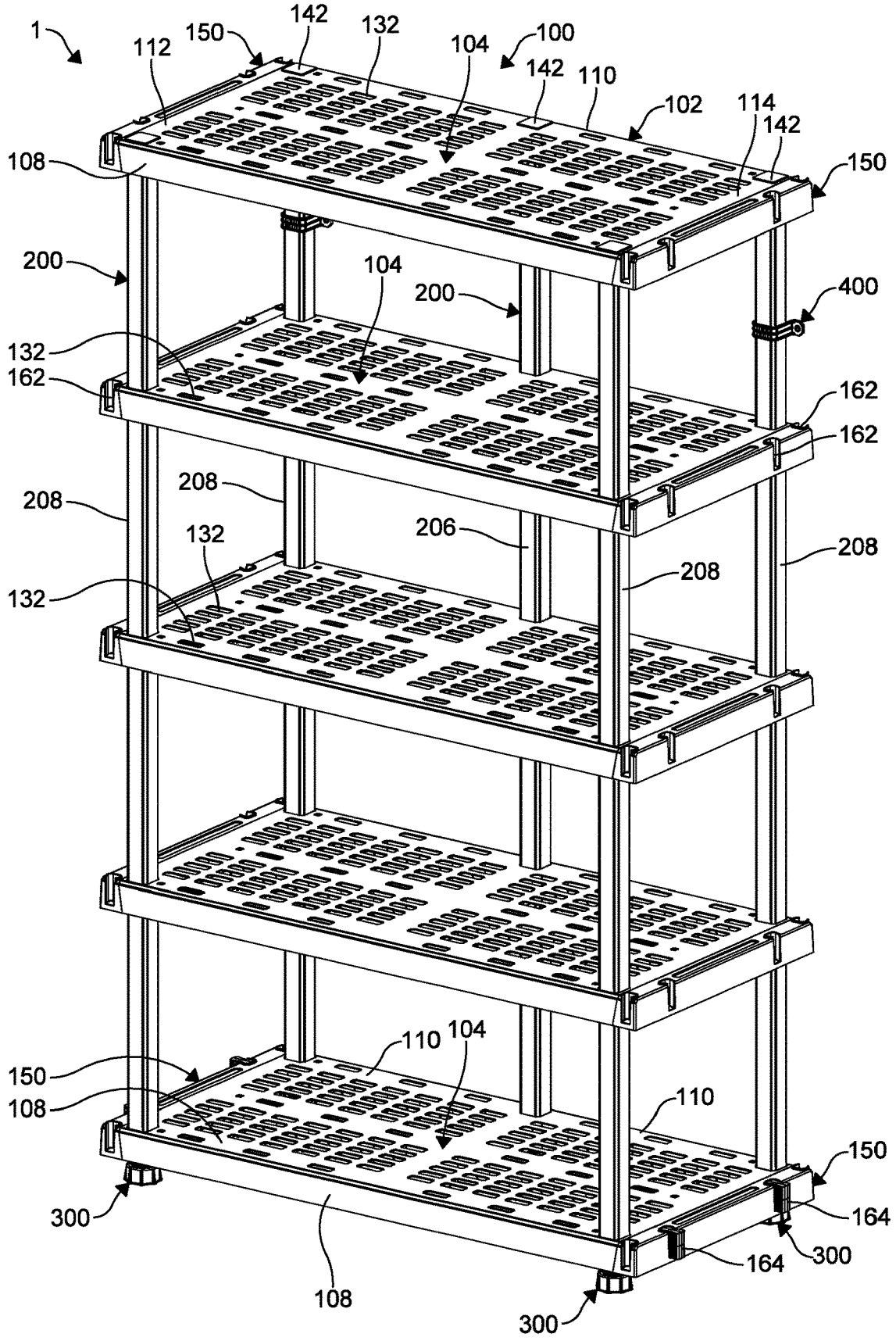
FIG. 1 is a top perspective view of a modular shelf assembly for a high capacity storage shelf according to one embodiment of the present disclosure.
Figure 2:
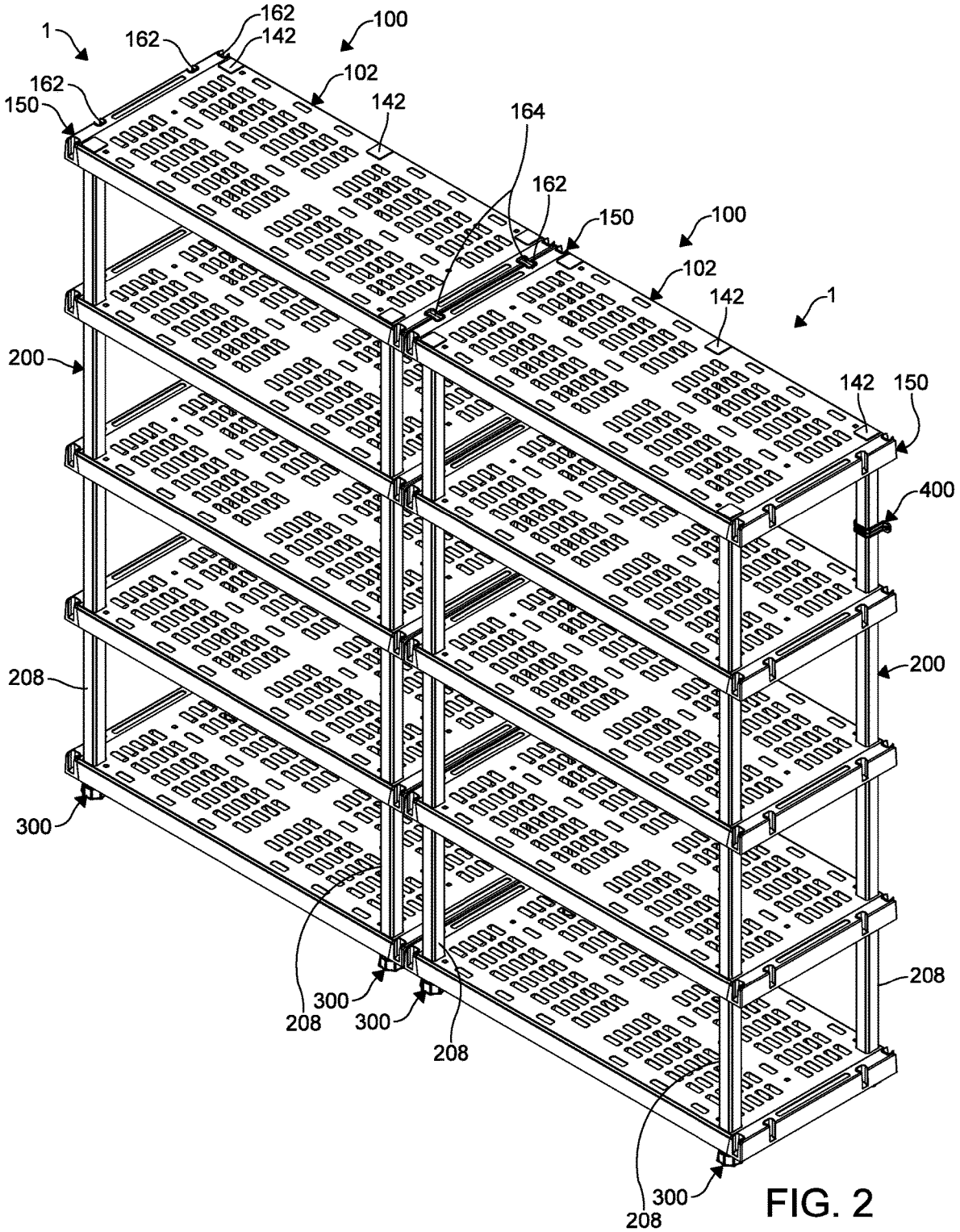
FIG. 2 is a top perspective view of two modular shelf assemblies joined by interlocking components.

In certain embodiments, each at least one shelf end cap 150 may have at least one interlocking aperture 162 formed at a peripheral edge thereof. The at least one interlocking apertures 162 may be configured to receive an interlocking component 164. The interlocking component 164 may have a symmetrical shape, which permits the interlocking component 164 to be jointly received by two of the at least one interlocking apertures 162 of the same shape. As shown in FIGS. 1-3, in one embodiment, the interlocking component 164 is generally H-shaped and the at least one interlocking apertures 162 are generally T-shaped to receive a portion of the H-shaped interlocking component 164. Advantageously, the at least one interlocking apertures 162 and the interlocking component 164 are used to connect multiple shelf assemblies 1 as shown in FIG. 2.

With further reference to FIGS. 1-3, each of the plurality of support posts 200, includes a first end 202 and a second end 204 that are configured for sliding frictional engagement with the end cap receiver 160 of the at least one shelf end cap 150 and the integral receiver 138 of the shelf body 102. The first end 202 of the plurality of support posts 200 may define a width less than a width of the lower support opening 136 of the shelf body 102 to facilitate fitting the first end 202 through the lower support opening 136 of the shelf body 102 into the end cap receiver 160 of the at least one shelf end cap 150. The second end 204 of the plurality of support posts 200 may define a width less than a width of the upper support opening 134 of the shelf body 102 to facilitate fitting the second end 204 through the upper support opening 134 of the shelf body 102 into the end cap receiver 160 of the at least one shelf end cap 150.

In certain embodiments, the first end 202 of one of the plurality of support posts 200 telescopically receives the second end 204 of another on of the plurality of support posts 200 to connect the two support posts, wherein the end cap receivers 160 of the at least one shelf end caps 150 and the integral receiver 138 of the shelf body 102 substantially surround the telescopic connection between two of the plurality of support posts 200 and maximize a strength thereof. In the illustrated embodiments, one of the plurality of support post 200 is provided between shelf bodies 102. It should be understood that two or more of the plurality of support posts 200 may be telescopically joined and disposed between two of the shelf bodies 102 in order to provide a desired distance between the shelf bodies 102.

The integral receiver post 206 received by the integral receiver 138 provided adjacent the rear side 110 of the shelf body 102 substantially increases the load carrying capability of the shelf unit 100 and the overall modular shelf assembly 1. The increase in load carrying capacity is achieved while maximizing the clear span distance on the front side 108 of the shelf body 102, which facilitates a user placing objects on the shelf body 102 of the modular shelf assembly 1.

The integral receiver post 206 cooperates with the integral receiver 138 and the integral receiver post 206 to minimize a deflection of the shelf body 102 when under a vertical load such as when objects are placed on the shelf body 102 of the modular shelf assembly 1. Furthermore, the reinforcing ribs 140 and the reinforcing wall 141, as well as the rear reinforcing bar 124*b* structurally connected to the integral receiver 138 cooperate with the integral receiver post 206 to strengthen the shelf body 102 and the overall modular shelf assembly 1. Further still, the integral receiver post 206 cooperates with the rear crossbar 122*c*, the rear reinforcing bar 124*b* and the reinforcing members 126, and the integral receiver 138 and the plurality of reinforcing ribs 140 and the reinforcing wall 141 to maximize the strength of the shelf body 102 and the overall modular shelf assembly 1.

Referring to FIGS. 1-4, the shelf unit 100 of the modular shelf assembly 1 may further include at least one cover 142. The at least one cover 142 is adapted to be disposed through the upper support opening 134 and received by the end cap receiver 160 as well as be received by the integral receiver 138. The at least one cover 142 are configured to telescopically attach to the first end 202 of the plurality of support posts 200 within the end cap receiver 160 and the integral receiver 138. It should be appreciated that the at least one cover 142 militates against items falling into the integral receiver 138, the end cap receivers 160, and the plurality of support posts 200 of the modular shelf assembly 1.

Referring to FIGS. 1-3, the modular shelf assembly 1 may include an adjustable foot 300 having a fixed member 302 and a moveable member 304. With respect to the corner post 208, the fixed member 302 is adapted to pass through the lower support opening 136 of the shelf body 102, be received by an end cap receiver 160 of the at least one shelf end cap 150, and telescopically connect to the second end 204 of the plurality of support posts 200. With respect to the integral receiver post 206, the fixed member 302 of the adjustable foot 300 is received by the integral receiver 138 formed in the shelf body 102 and telescopically connected to the second end 204 of the integral receiver post 206. The moveable member 304 is adapted to be moveably connected to the fixed member 302, wherein the moveable member 304 can be selectively moved with respect to the fixed member 302 to change an overall length of the adjustable foot 300 to facilitate a leveling of the modular shelf assembly 1. In the illustrated embodiment, the fixed member 302 and the moveable member 304 of the adjustable foot 300 are threaded to allow for relative rotational movement therebetween. It should be understood that other types of adjustable feet may be employed to facilitate changing the length of the foot and the leveling of the modular shelf assembly 1.

With continued reference to FIGS. 1-3, the modular shelf assembly 1 may further include an anchor 400 configured to secure the modular shelf system 1 to an adjacent wall or other support structure. The anchor 400 includes a wall 402 with an outwardly extending protrusion 404 at each end thereof. Each outwardly extending protrusion 404 includes a through hole 406. The anchor 400 is configured to engage at least a portion of the plurality of support posts 200 wherein the through hole 406 are adapted to receive an attachment feature, such as a nail or screw, for example, to facilitate attaching the anchor 400 to a wall or other support structure. The anchor 400 militates against the modular shelf system 1 from tipping over. It should be appreciated that while two of the anchors 400 are shown in FIGS. 1-3, one skilled in the art may employ any number of the anchors 400, as desired.

Figure 8:
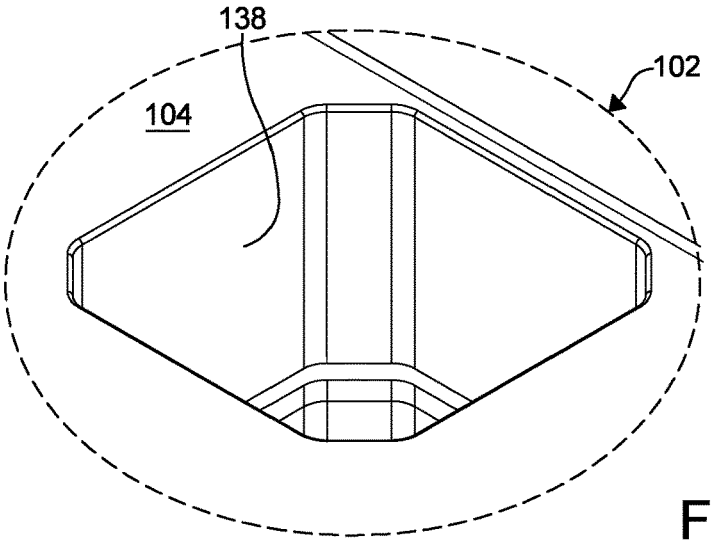
FIG. 8 is an enlarged, fragmentary top perspective view of a shelf unit taken at call-out C in FIG. 4, showing the substantially square shaped integral receiver.

As shown in FIGS. 1-8, the plurality of support posts 200 as well as the upper support openings 134 and the lower support openings 136, the integral receiver 138 of the shelf body 102, and the end cap receivers 160 of the at least one shelf end cap 50 are substantially square shaped, wherein the corners thereof are radiused and/or chamfered. The cooperating generally square shapes facilitates an assembly of the modular shelf assembly 1. It should be understood that other geometric shapes may be utilized as desired. For example, and as shown in FIGS. 8-9, respectively, an octagonal and a round geometric shape are shown for the integral receiver 138. It should also be understood that the plurality of support posts 200, the upper support openings 134 and the lower support openings 136 and the integral receiver 138 of the shelf body 102, the end cap receivers 160 of the at least one shelf end cap 150, the at least one cover 142, the adjustable foot 300, and the anchor 400 may also have octagonal, round, or other cooperating geometric shapes to facilitate the assembly of the modular shelf assembly 1.

Additionally, in various embodiments, the shelf unit 100, the plurality of support posts 200, the at least one cover 142, the adjustable foot 300, the anchor 400, and the interlocking component 164 may be sold separately as a kit. The kit enables the user to construct shelf assemblies 1 of varying heights and widths, as desired.

While certain representative embodiments and details have been shown for purposes of illustrating the present disclosure, it will be apparent to those skilled in the art that various changes may be made without departing from the scope of the disclosure, which is further described in the following appended claims.

What is claimed is:

1. A shelf unit for a shelf assembly, comprising:

a shelf body having a first end, a second end, a front side, a rear side, and an integral receiver, the integral receiver disposed adjacent the rear side of the shelf body between the first end and the second end of the shelf body, wherein the integral receiver is reinforced by at least one reinforcing rib integrally connected to the integral receiver and an adjacent wall, wherein the shelf body has at least one crossbar, the at least one crossbar is disposed between the first end and the second end of the shelf body, and the integral receiver is disposed in the at least one crossbar; and a plurality of support posts, one of the plurality of support posts being an integral receiver post received by the integral receiver of the shelf body.

2. The shelf unit of claim 1, wherein the shelf body has at least one reinforcing bar connected to the integral receiver and extending toward the front side of the shelf body.

3. The shelf unit of claim 1, wherein the shelf body has at least one reinforcing bar, and the at least one reinforcing bar is disposed between the at least one crossbar and one of the front side and the rear side of the shelf body.

4. The shelf unit of claim 3, wherein the at least one reinforcing bar includes a plurality of reinforcing members.

5. The shelf unit of claim 1, wherein the shelf body has a plurality of reinforcing strips, and each of the plurality of reinforcing strips is disposed between the at least one crossbar and one of the front side and the rear side of the shelf body.

6. The shelf unit of claim 1, wherein the at least one crossbar is at least three crossbars, and a first crossbar is disposed adjacent the front side of the shelf body, a second crossbar is disposed adjacent the rear side of the shelf body, and a third crossbar is disposed between the first crossbar and the second crossbar.

7. The shelf unit of claim 6, wherein the shelf body has at least two reinforcing bars, and a first reinforcing bar is disposed between the first crossbar and the third crossbar and a second reinforcing bar is disposed between the second crossbar and the third crossbar.

8. The shelf unit of claim 6, wherein the shelf body has a plurality of reinforcing strips, and each of the plurality of reinforcing strips is disposed between the first crossbar and the third crossbar or the second crossbar and the third crossbar.

9. The shelf unit of claim 1, wherein the shelf body includes at least one cover, and the at least one cover is inserted into the integral receiver of the shelf body.

10. The shelf unit of claim 1, wherein the shelf body includes at least one foot, and the at least one foot is inserted into the integral receiver of the shelf body.

11. The shelf unit of claim 1 including at least one anchor, wherein the at least one anchor cooperates with at least one of the plurality of support posts to facilitate securing the shelf unit to an adjacent structure.

12. A modular shelf assembly, comprising:

a shelf unit including a shelf body and at least one shelf end cap, the shelf body having a first end, a second end, a front side, a rear side, at least one connecting arm opening, at least one upper support opening and at least one lower support opening, and an integral receiver, the integral receiver disposed adjacent the rear side of the shelf body between the first end and the second end of the shelf body and the integral receiver being reinforced by at least one reinforcing member integrally connected to the integral receiver and an adjacent wall, the at least one shelf end cap having at least one connecting arm with at least one end cap receiver formed in the at least one connecting arm, the at least one connecting arm received in the at least one connecting arm opening in the shelf body, the at least one end cap receiver in substantial axial alignment with the at least one upper support opening and the at least one lower support opening of the shelf body;

a plurality of support posts, one of the plurality of support posts is an integral receiver post received by the integral receiver of the shelf body and at least one of the plurality of support posts is a corner post received by the at least one end cap receiver; and at least one anchor, the at least one anchor cooperating with at least one of the plurality of support posts to facilitate securing the shelf unit to an adjacent structure.

13. The modular shelf assembly of claim 12, wherein the shelf body includes a first crossbar disposed adjacent the front side of the shelf body, a second crossbar disposed adjacent the rear side of the shelf body, a third crossbar disposed between the first crossbar and the second crossbar, and a plurality of reinforcing strips disposed between both the first crossbar and the third crossbar and the second crossbar and third crossbar.

14. The modular shelf assembly of claim 13, wherein the integral receiver is disposed in the second crossbar and the shelf body includes a first reinforcing bar disposed between the first crossbar and the third crossbar and a second reinforcing bar disposed between the second crossbar and the third crossbar, and an end of the second reinforcing bar is integrally connected to the integral receiver.

15. The modular shelf assembly of claim 12 including:

a plurality of covers, wherein each of the plurality of covers is received by one of the integral receiver of the shelf body and the at least one end cap receiver of the at least one shelf end cap; and a plurality of feet, wherein each of the plurality of feet is received by one of the integral receiver of the shelf body and the at least one end cap receiver of the at least one shelf end cap.

16. A kit for a shelf assembly, comprising:

a shelf unit including a shelf body and at least one shelf end cap, the shelf body having a first end, a second end, a front side, a rear side, at least one connecting arm opening, at least one upper support opening and at least one lower support opening, and an integral receiver, the integral receiver disposed adjacent the rear side of the shelf body between the first end and second end of the shelf body and the integral receiver is reinforced by at least one reinforcing member integrally connected to the integral receiver and an adjacent wall, the at least one shelf end cap having at least one connecting arm with at least one end cap receiver formed in the at least one connecting arm, the at least one connecting arm configured to be received in the at least one connecting arm opening in the shelf body and position the at least one end cap receiver in substantial axial alignment with the at least one upper support opening and the at least one lower support opening of the shelf body;

a plurality of support posts, one of the plurality of support posts being an integral receiver post configured to be received by the integral receiver of the shelf body and at least one of the plurality of support posts being a corner post configured to be received by the at least one end cap receiver;

at least one anchor, the at least one anchor being configured to cooperate with at least one of the plurality of support posts to facilitate securing the shelf unit to an adjacent structure;

a plurality of covers, each of the plurality of covers being configured to be received by one of the integral receiver of the shelf body and the at least one end cap receiver of the at least one shelf end cap; and a plurality of feet, each of the plurality of feet being configured to be received by one of the integral receiver of the shelf body and the at least one end cap receiver of the at least one shelf end cap.

17. A shelf unit for a shelf assembly, comprising:

a shelf body having a first end, a second end, a front side, a rear side, and an integral receiver, the integral receiver disposed adjacent the rear side of the shelf body between the first end and the second end of the shelf body, wherein the integral receiver is reinforced by at least one reinforcing rib integrally connected to the integral receiver and an adjacent wall, wherein the shelf body includes a first receiving hole at a front right corner, a second receiving hole at a front left corner, a third receiving hole at a rear right corner, a fourth receiving hole at a rear left corner, and a fifth receiving hole comprising the integral receiver between the third and fourth receiving holes, wherein the third receiving hole, the fourth receiving hole, and the fifth receiving hole are equally spaced along the rear side of the shelf body; and a plurality of support posts, one of the plurality of support posts being an integral receiver post received by the integral receiver of the shelf body.

18. A shelf unit for a shelf assembly, comprising:

a shelf body having a first end, a second end, a front side, a rear side, and an integral receiver, the integral receiver disposed adjacent the rear side of the shelf body between the first end and the second end of the shelf body, wherein the shelf body has at least one crossbar disposed between the first end and the second end of the shelf body, the at least one crossbar includes at least three crossbars, and a first crossbar is disposed adjacent the front side of the shelf body, a second crossbar is disposed adjacent the rear side of the shelf body, and a third crossbar is disposed between the first crossbar and the second crossbar, the shelf body has at least two reinforcing bars including a first reinforcing bar disposed between the first crossbar and the third crossbar and a second reinforcing bar disposed between the second crossbar and the third crossbar, and the integral receiver is disposed in the second crossbar and an end of the second reinforcing bar is connected to the integral receiver; and a plurality of support posts, one of the plurality of support posts being an integral receiver post received by the integral receiver of the shelf body.

* * * * *